US010618059B2

(12) United States Patent
Nepomuceno Do Valle

(10) Patent No.: US 10,618,059 B2
(45) Date of Patent: Apr. 14, 2020

(54) SPARGER DEVICE FOR SPARGING A FLUID INTO A SLURRY TANK, FLOTATION APPARATUS AND SYSTEM HAVING SUCH SPARGER DEVICE, AND METHOD FOR SETTING CONTROL FLUID PRESSURE OF A SPARGER DEVICE

(71) Applicant: OUTOTEC (FINLAND) OY, Espoo (FI)

(72) Inventor: Thiago Antonio Nepomuceno Do Valle, Belo Horizonte (BR)

(73) Assignee: OUTOTEC(FINLAND) OY, Espoo (FI)

( * ) Notice: Subject to any disclaimer, the term of this patent is extended or adjusted under 35 U.S.C. 154(b) by 0 days.

(21) Appl. No.: 16/431,129

(22) Filed: Jun. 4, 2019

(65) Prior Publication Data

US 2019/0283041 A1 Sep. 19, 2019

Related U.S. Application Data

(63) Continuation of application No. PCT/FI2016/050860, filed on Dec. 9, 2016.

(51) Int. Cl.
*B03D 1/00* (2006.01)
*B03D 1/24* (2006.01)
(Continued)

(52) U.S. Cl.
CPC ..... *B03D 1/242* (2013.01); *B03D 1/028* (2013.01); *B03D 1/1487* (2013.01)

(58) Field of Classification Search
CPC ..... B03D 1/242; B03D 1/028; B03D 1/1487
(Continued)

(56) References Cited

U.S. PATENT DOCUMENTS 3,410,518 A 11/1968 Carsten
3,986,954 A * 10/1976 George ..... B03D 1/24 210/706

(Continued)

FOREIGN PATENT DOCUMENTS

CA 3 032 016 A1 * 3/2018
CN 201231183 Y 5/2009
DE 1403368 A1 3/1969

OTHER PUBLICATIONS

International Search Report issued by the Finnish Patent and Registration Office acting as the International Searching Authority in relation to International Application No. PCT/FI2016/050860 dated Mar. 8, 2017 (6 pages).

(Continued)

*Primary Examiner* — Charles S Bushey
(74) *Attorney, Agent, or Firm* — Robert P. Michal, Esq.; Carter, DeLuca & Farrell LLP

(57) ABSTRACT

A sparger device for sparging fluid into a slurry tank includes a hollow elongated body having a nozzle opening for sparging a sparging fluid flow to a slurry tank. The device further includes a needle for opening and closing the nozzle opening, and a control device being arranged to actuate the needle. The control device includes a control chamber partitioned into a first portion and second portion such that a pressure differential between the first portion and the second portion, closes or opens the nozzle opening and prevents slurry backflow from the slurry tank. The second portion may be provided with a control fluid pressure preventing slurry. A flotation apparatus and a flotation system in with such a sparger device are also discussed.

8 Claims, 1 Drawing Sheet

(51) Int. Cl.
*B03D 1/02* (2006.01)
*B03D 1/14* (2006.01)

(58) Field of Classification Search
USPC ..... 261/64.1, 64.3, 77, 121.1, 124
See application file for complete search history.

(56) References Cited

U.S. PATENT DOCUMENTS

| | | | | |
|---|---|---|---|---|
| 5,139,663 | A | 8/1992 | Maples | |
| 5,814,228 | A | 9/1998 | Hubred et al. | |
| 9,285,046 | B2 * | 3/2016 | Tonegawa | F25B 41/062 |

OTHER PUBLICATIONS

Written Opinion of the International Searching Authority issued by the Finnish Patent and Registration Office acting as the International Searching Authority in relation to International Application No. PCT/FI2016/050860 dated Mar. 8, 2017 (8 pages).
International Preliminary Report on Patentability issued by the European Patent Office acting as the International Preliminary Examining Authority in relation to International Application No. PCT/FI2016/050860 dated Feb. 7, 2019 (5 pages).
Written Opinion of the International Preliminary Examining Authority issued by the European Patent Office acting as the International Preliminary Examining Authority in relation to International Application No. PCT/FI2016/050860 dated Nov. 7, 2018 (7 pages).
*According to CFR 1.98(a)(3) Applicants submit the Written Opinion and an English translation of DE 14 03 368 to show proof of relevance.

* cited by examiner

SPARGER DEVICE FOR SPARGING A FLUID INTO A SLURRY TANK, FLOTATION APPARATUS AND SYSTEM HAVING SUCH SPARGER DEVICE, AND METHOD FOR SETTING CONTROL FLUID PRESSURE OF A SPARGER DEVICE

CROSS-REFERENCE TO RELATED APPLICATIONS

This application is a continuation of PCT International Patent Application No. PCT/FI2016/050860 filed Dec. 9, 2016. The disclosure of which is expressly incorporated herein by reference in its entirety.

FIELD OF THE DISCLOSURE

The present disclosure relates to sparger devices, and more specifically sparger devices for sparging fluid into a slurry tank. The present disclosure further concerns a flotation apparatus having such a sparger device, and a flotation system in which a flotation apparatus having such a sparger device is used. In addition, the present disclosure concerns a method for setting a control fluid pressure of a sparging device.

BACKGROUND OF THE DISCLOSURE

Sparger devices are commonly used for introducing a fluid flow, such as an airflow, a mixture of air and another gas, a mixture of gas and a water flow, a mixture of air and a water flow or any combination thereof, into slurry in such a manner that bubbles and/or froth is generated.

For a sparger device to operate properly, it is important that no impurities are introduced into the sparger device, particularly a nozzle opening thereof, as any impurities could hinder the flow of the sparging fluid or otherwise result in reduced operational capabilities. This is particularly prominent in flotation applications, where the slurry to be sparger contains solids in the form of mineral particles.

During normal operation, the flow of the sparging fluid itself prevents slurry backflow via the nozzle opening of the sparger device. However, if the flow of the sparging fluid is interrupted the fluid pressure of the slurry, namely hydrostatic pressure within the slurry tank, induces a slurry backflow via the nozzle opening unless this is somehow prevented.

Document CN 201231183 Y discloses a sparger device, in which a biasing spring is used to bias a needle against a nozzle opening. U.S. Pat. No. 5,139,663 a discloses a discharge valve for a flotation system, which discharge valve is actuated by a piston member coupled to a cap for opening or closing a discharge opening. U.S. Pat. No. 3,410,518 a discloses a self-closing valve arrangement.

BRIEF DESCRIPTION OF THE DISCLOSURE

An object of the present disclosure is to provide a sparger device for sparging fluid into a slurry tank, which sparger device may efficiently be used in different operating conditions, e.g. with slurries of different types, at different positions of a slurry tank, and/or with tanks of different height, while ensuring that slurry backflow is prevented if the flow of sparging fluid is interrupted.

This object is achieved by a sparger device having a hollow elongated body having a nozzle opening at a distal end thereof for sparging a sparging fluid flow to a slurry tank from an inside of the hollow elongated body, a needle movably arranged along a longitudinal axis of the sparger device within the hollow elongated body, and a control device. The needle has a first end for opening and closing the nozzle opening in order to allow and block fluid flow via the nozzle opening. The control device is coupled with a second end of the needle and is arranged to actuate the needle along the longitudinal axis so as to open or close the nozzle opening. The control device includes a control chamber partitioned by a piston member into a first portion and a second portion. The piston member is coupled with the needle and configured to be movable within the control chamber along the longitudinal axis in response to a pressure differential between the first portion and the second portion. A lower fluid pressure in the first portion with respect to that of the second portion will move the needle against the nozzle opening, thereby closing it, and a higher fluid pressure in the first portion with respect to that of the second portion will move the needle away from the nozzle opening, thereby opening it. The first portion of the control chamber is in fluid communication with the inside of the elongated hollow body, thereby defining the fluid pressure within the first portion to equal with that of the sparging fluid supply, when in use. The second portion of the control chamber is configurable for being in fluid communication with a control fluid, thereby defining the fluid pressure within the second portion to equal with that of a control fluid, when in use. Backflow of slurry from the slurry tank to the sparger device via the nozzle opening may be prevented by providing a control fluid pressure exerting, on the piston member, a force greater than that exerted on the first end of the needle by the fluid pressure of the slurry tank at a level of the sparger device. The control device includes a pressure sensor for providing information indicative of the fluid pressure within the second portion of the control chamber. The sparger device includes a charging valve for charging the second portion of the control chamber with a desired control fluid pressure. The charging valve is provided as a pneumatic or hydraulic quick coupling connector.

It is a further object of the present disclosure to provide a flotation apparatus having such a sparger device, and a flotation system in which a flotation apparatus having such a sparger device is used, and a method for setting a control fluid pressure of such a sparging device.

The disclosure is based on the idea of providing sparger device with a control device having a control chamber partitioned into two portions such that the pressure differential between these portions closes or opens the nozzle opening. Moreover, the fluid pressure of the first portion is determined by the sparging fluid, and the fluid pressure of the second portion is determined by a control fluid. Hence, the control fluid pressure may be set such that the interruption of the sparging fluid flow causes the nozzle opening to close, thus preventing slurry backflow.

An advantage of solutions according to the disclosure is that the control fluid pressure may be easily set to correspond to different operation conditions. As a result, a single sparger device can be easily adapted for different types of slurries, different position at a slurry tank, and/or for different types of slurry tanks simply by changing the control fluid pressure.

In conventional sparger device a biasing spring has been used to bias a needle against a nozzle opening to prevent backflow. However, adapting such sparger device for different operating conditions has required a separate screw for pre-tensioning the spring or using a different spring altogether. Fatigue over time of such springs has also been an issue.

BRIEF DESCRIPTION OF THE DRAWINGS

In the following the disclosure will be described in greater detail by means of preferred embodiments with reference to the accompanying drawings, in which.

DETAILED DESCRIPTION OF THE DISCLOSURE

Figure 1:
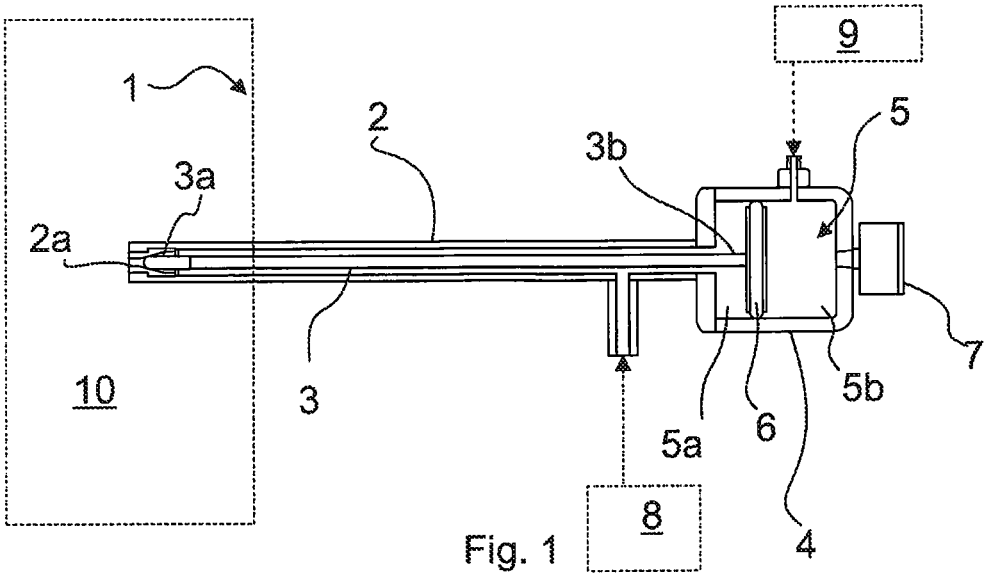
FIG. 1 illustrates schematically a sparger device according to the disclosure in connection with a slurry tank.

According to an embodiment of a first aspect of the disclosure, a sparger device 1 for sparging fluid into a slurry tank 10, is provided.

The sparger device 1 comprises a hollow elongated body 2 having a nozzle opening 2*a* at a distal end thereof for sparging a sparging fluid flow to a slurry tank 10 from an inside of the hollow elongated body 2. The inside of the elongated hollow body 2 is configurable for fluid communication with a sparging fluid supply 8, when in use. Suitably, the sparger device 1 comprises a connector connecting the inside of the hollow body 2 to a sparging fluid supply 8.

The sparger device 1 further comprises a needle 3 movably arranged along a longitudinal axis of the sparger device 1 within the hollow elongated body 2. The needle 3 has a first end 3*a* for opening and closing the nozzle opening 2*a* in order to allow, and respectively block, fluid flow via the nozzle opening 2*a*. Particularly, the first end 3*a* of the needle 3 may block sparging fluid flow from the inside of the hollow elongated body 2 to the slurry tank 10 via the nozzle opening 2*a*, and respectively, block slurry backflow from the slurry tank 10 to the inside of the hollow elongated body 2 via the nozzle opening 2*a*.

The sparger device 1 further comprises a control device 4 coupled with a second end 3*b* of the needle 3. The control device is arranged to actuate the needle 3 along the longitudinal axis so as to open or close nozzle opening 2*a*.

The control device 4 comprises a control chamber 5 partitioned by a piston member 6 into a first portion 5*a* and second portion 5*b*. Suitably, the piston member 6 partitions the control chamber 5 such that there is no fluid communication between the first portion 5*a* and the second portion 5*b*. The piston member 6 is coupled with the needle 3, and configured to be movable within the control chamber 5 along the longitudinal axis in response to a pressure differential between the first portion 5*a* and the second portion 5*b*.

Particularly, the piston member is configured such, that a lower fluid pressure in the first portion 5*a* with respect to that of the second portion 5*b* will move the needle 3 against the nozzle opening 2*a*, thereby closing it. Respectively, a higher fluid pressure in the first portion 5*a* with respect to that of the second portion 5*b* will move the needle away from nozzle opening 2*a*, thereby opening it.

The first portion 5*a* of the control chamber 5 is in fluid communication with the inside of the elongated hollow body 2, thereby defining the fluid pressure within the first portion 5*a* to equal with that of the sparging fluid supply 8, when in use.

The second portion 5*b* of the control chamber 5 is configurable for being in fluid communication with a control fluid, thereby defining the fluid pressure within the second portion 5*b* to equal with that of a control fluid, when in use.

Thus, backflow of slurry from the slurry tank 10 to the sparger device 1 via the nozzle opening 2*a* may be prevented by providing a control fluid pressure exerting, on the piston member 6, a force greater than that exerted on the first end 3*a* of the needle 3 by the fluid pressure of the slurry tank 10 at a level of the sparger device 1.

When no sparging fluid is sparged i.e. injected via the nozzle opening 2*a*, the hydrostatic pressure within the slurry tank 10 at the level of the sparger device 1 strives to induce a slurry backflow from the tank to the inside of the hollow elongated body 2. Sparging fluid flow may be stopped, e.g. when the sparging process is halted or when there is a malfunction in the sparging fluid supply. Moreover, as slurry has a high solids particle content, any slurry contamination within the sparger device 1 is undesirable, as it may prevent the sparger device 1 from operating in desired manner, or even break it.

Backflow of the slurry from the slurry tank 10 to the sparger device 1 may be prevented by providing a control device 4, which closes the nozzle opening 2*a* when sparging fluid flow is stopped.

A sparger device 1 may be used with different types of slurry, having different density properties, with different types of slurry tanks, or at different positions of slurry tank, corresponding to different hydrostatical pressures of the slurry. Hence, there is a need to adjust the force exerted on the needle for closing the nozzle opening for different operating conditions. Particularly, the force exerted on the needle for closing the nozzle opening 2*a* has to be greater than the force exerted on the needle 3 by the hydrostatic pressure of the slurry. On the other hand, the pressure used for feeding the sparging fluid has to overcome the force exerted on the needle 3 for closing it. Hence, it is not desirable to use an unnecessarily great force for closing needle, as this means that an unnecessarily high pressure has to be used for sparging the sparging fluid, which results in weaker overall efficiency of the sparging process and hinders the accurate control of the sparging fluid flow.

According to another embodiment of the first aspect of the disclosure, the control device 4 comprising a pressure sensor 7 for providing information indicative of the fluid pressure within the second portion 5*b* of the control chamber 5. This enables verification of the actual pressure level of the control fluid within second portion 5*b*. This, in turn, ensures, that the control fluid within the second portion 5*b* of the control chamber 5 may be kept at desired pressure level at all times.

Preferably, but not necessarily, the pressure sensor 7 is arranged on a continuation of the longitudinal axis of the sparger device 1. Such an arrangement ensures that, if the sparger device is installed horizontally, the pressure sensor 7 will never be located in a lowermost position of the second portion 5*b* of the control chamber 5, regardless of the rotational orientation of the sparger device about its longitudinal axis. It is not desirable to locate the pressure sensor 7 in a lowermost position of the second portion 5*b*, as any contamination, impurities, or possible water condensation will accumulate to said lowermost position under gravity. This may result in malfunction of the pressure sensor, which may result in a an incorrect fluid pressure at the second portion 5*b*. Furthermore, incorrect control fluid pressure may lead to the sparger device 1 being damaged if the nozzle opening 2*a* is not correctly closed, and backflow of the slurry occurs.

According to a further embodiment of the first aspect of the present disclosure, the second portion 5*b* of the control chamber 5 is configurable for being in fluid communication with a control fluid supply 9. Suitably, this is done by providing the sparger device 1 with a connector connecting the second portion 5*b* of the control device 5 to a control fluid supply 9.

Alternatively, or additionally, the sparger device 1 may comprise a charging valve for charging the second portion 5*b* of the control chamber 5 with a desired control fluid pressure. That is, the second portion 5*b* may hold the desired control fluid pressure by itself. Alternatively, the second portion 5*b* may be arranged in fluid communication with, a control fluid accumulator. Moreover, in such an arrangement, the second portion 5*b* does not need to be in constant fluid communication with a separate control fluid supply 9, thus eliminating the need for a separate flow route between the control fluid supply 9 and the second portion 5*b*. In turn, the fluid pressure in the second portion can be adjusted via the charging valve as necessary. Particularly pneumatic or hydraulic quick coupling connectors or valves commonly used with pneumatic tires may be used as the charging valve.

According to a second aspect of the present disclosure, a flotation apparatus comprising a slurry tank is provided. In such a flotation apparatus, solids are separated from the slurry by sparging a fluid, most commonly compressed air, into the slurry tank 10 containing a slurry. Typically, the slurry is a mixture of a liquid portion and a solids portion, most often comprising solid particles of minerals. As the sparging fluid forms bubbles and/or froth, the solids particles adhere thereto. Moreover, the bubbles and/or froth rise up to the surface of the slurry within the slurry tank together with the adhered solids particles. From thereon, the solids particles can be recovered from the surface of the slurry.

Particularly, the flotation apparatus further comprises at least one sparger device 1 according to any embodiment of the first aspect of the present disclosure, as discussed above. Moreover, the sparger device 1 is arranged such that at least the nozzle opening 2*a* is within the slurry tank 10. Most suitably, the sparger device 1 is positioned such that the nozzle opening 2*a* is within the slurry tank 10 below an envisaged level of the slurry, when in use. The nozzle opening 2*a* may, however, be located at a desired position within the slurry tank 10, although it generally desirable to locate the nozzle opening 2*a* near the bottom of the tank, thus enabling the bubbles and/or froth generated by the sparging to travel through the whole height of the slurry within the slurry tank 10.

Moreover, the sparger device 1 may be arranged such that the elongated hollow body 2 extends horizontally within the slurry tank 10. This ensures, that the nozzle opening 2*a* may be positioned at a distance form a wall of the slurry tank 10. This is desirable so that the bubbles/froth generated by sparging do not travel against the wall of the tank 10, but amongst the slurry, adhering solids particles more efficiently. Suitably, the sparger device 1 is positioned horizontally, i.e. the elongated hollow body 2 runs level with the horizontal. This is particularly beneficial when a sparger device having a pressure sensor 7 located on a continuation of the longitudinal axis of the sparger device 1 is used. Such an arrangement ensures that the sparger device 1 can not be installed in an incorrect orientation causing the pressure sensor 7 to malfunction, as discussed above in connection with the respective embodiment of the first aspect of the present disclosure.

In the flotation apparatus, the sparger device 1 is preferably configured such that the second portion 5*b* of the control chamber 5 comprises control fluid. More specifically, the control fluid in the second portion 5*b* is arranged at a control fluid pressure exerting, on the piston member 6, a force greater than that exerted on the first end 3*a* of the needle 3 by a fluid pressure prevailing in the slurry tank 10 at a level of the sparger device 1. The force exerted on the piston member by the control fluid can be determined simply by considering the area of the piston member and the fluid pressure of the control fluid. The force exerted on the first end 3*a* of the needle, in turn, can be determined by considering the area of the first end 3*a* and the pressure prevailing within the slurry tank at the level of the sparger device 1, specifically the nozzle opening 2*a* thereof. Moreover, the fluid pressure prevailing within the slurry tank 10 at the level of the sparger device 1 can be determined by considering the local atmospheric pressure within the tank, in addition to the density of the slurry and the height of the slurry column, i.e. hydrostatic pressure.

It should be understood that more than one sparging device 1 may be used in connection with a flotation apparatus according to any embodiment of the second aspect of the present disclosure, as described above.

According to a third aspect of the present disclosure, a flotation system is provided. The flotation system comprises at least one flotation apparatus according to any of the embodiments of the second aspect of the present disclosure, as discussed above.

The flotation system further comprises a sparging fluid supply 8 arranged to be in fluid communication with the inside of the hollow elongated body 2 of the sparger device 1 in order to sparge said sparging fluid into the flotation tank. For example, a compressed air supply, such as a blower or compressor may be used as a sparging fluid supply 8.

The flotation system further comprises a control fluid supply 9 arranged to be in fluid communication with the second portion 5*b* of the control chamber 5 for providing a control fluid pressure within the second portion 5*b* of the control chamber 5. For example, a compressed air supply, such as a blower or compressor may be used as a control fluid supply 9.

Particularly, the sparging fluid supply 8 and the control fluid supply 9 are suitably associated with respective separate devices. For example, separate compressed air supplies, such as blowers or compressors may be used as the respective separate devices. Such an arrangement ensures, that a control fluid supply 9 will continue to provide control fluid 9 if the sparging fluid supply 8 malfunctions. As a consequence, slurry backflow will not occur due to sparging fluid supply 8 malfunction.

Alternatively, a single physical device may be used for providing both the sparging fluid and the control fluid. In such an arrangement a combination of valves are suitably provided for achieving a desired fluid pressure differential between the first portion 5*a* and the second portion 5*b* of the control chamber, and for ensuring that that the control fluid pressure is maintained if the sparging fluid flow is interrupted even in the case of a malfunction of the single physical device providing both the sparging fluid and the control fluid. For example, a pressure regulator may be provided between the second portion 5*a* of the control chamber 5 and the single device providing both the sparging fluid and the control fluid in order to achieve a desired control fluid pressure. Moreover, check-valve may be provided between the second portion 5*a* of the control chamber 5 and the single device providing both the sparging fluid and the control fluid for ensuring that the control fluid will not flow out of the second portion 5*b* and the desired control fluid pressure is maintained if the single physical device providing both the sparging fluid and the control fluid malfunctions.

According to a fourth aspect of the present disclosure, a method of setting a control fluid pressure of a sparger device 1 is provided.

Firstly, a sparger device 1 having a charging valve for charging the second portion 5*b* of the control chamber 5 with a desired control fluid pressure, as discussed in connection with the respective embodiment of the first aspect of the present disclosure, is provided.

Secondly, a detachable control fluid supply 11 is provided. Any fluid supply that can provide suitable fluid and can be detached from the sparger device 1 may be used. For example, a compressed air system having a detachable quick coupling connector corresponding to the charging valve may be used. In addition to conventional quick coupling connectors providing firm connections, inflation connectors of more temporary nature, such as inflation connectors commonly used for inflating pneumatic tires, may be used as a detachable quick coupling connector in the context of this disclosure. Suitably, a portable detachable control fluid supply 11 is provided. Such a portable control fluid supply 11 facilitates setting the control fluid pressure when several sparger devices 1 are used, as such a portable detachable control fluid supply 11 can easily be attached, removed and moved to the next sparger device.

The method further comprises determining a desired control fluid pressure. The control fluid pressure suitably exerts, on the piston member 6, a force greater than that exerted on the first end 3*a* of the needle 3 by a fluid pressure prevailing in the slurry tank 10 at a level of the sparger device 1. The force exerted on the piston member by the control fluid can be determined simply by considering the area of the piston member and the fluid pressure of the control fluid. The force exerted on the first end 3*a* of the needle, in turn, can be determined by considering the area of the first end 3*a* and the pressure prevailing within the slurry tank at the level of the sparger device 1, specifically the nozzle opening 2*a* thereof. Moreover, the fluid pressure prevailing within the slurry tank 10 at the level of the sparger device 1 can be determined by considering the local atmospheric pressure within the tank, in addition to the density of the slurry and the height of the slurry column, i.e. hydrostatic pressure.

The method further comprises connecting the detachable control fluid supply 11 to the charging valve for establishing fluid communication between the second portion 5*b* of the control chamber 5 and the detachable control fluid supply. It is not necessary to attach the detachable control fluid supply to the charging valve in a rigid manner, but it is sufficient that a fluid communication therebetween is established. Moreover, the second portion 5*b* of the control chamber 5 is charged with a desired control fluid pressure.

Figure 2:
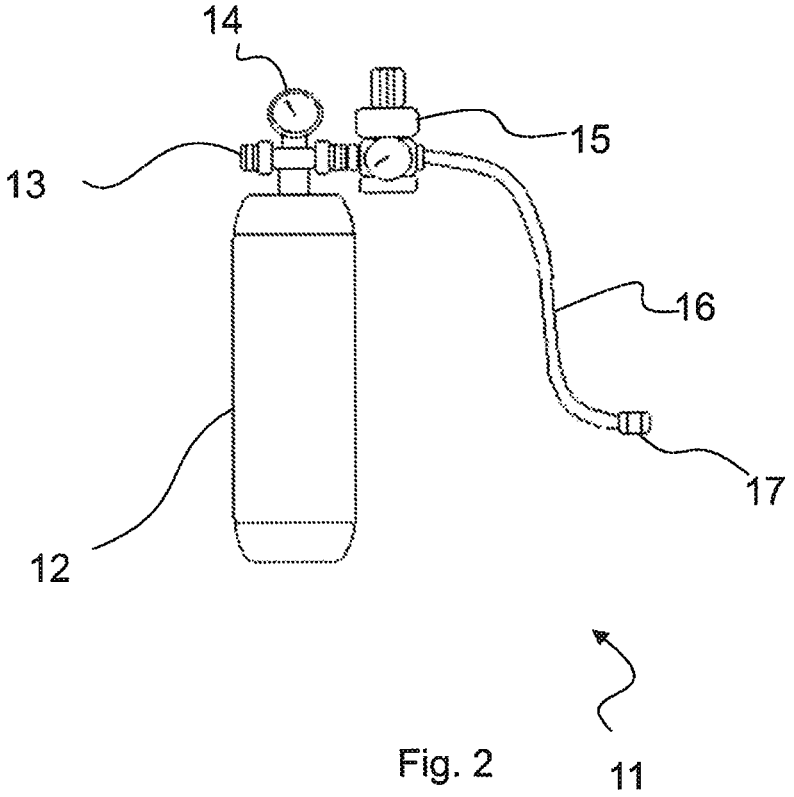
FIG. 2 illustrates schematically a portable detachable control fluid supply.

In FIG. 2, an example of a detachable portable control fluid supply 11 is illustrated. The detachable portable control fluid supply comprises a control fluid tank 12, and arranged in fluid connection therewith, a fill valve 13, a pressure gauge 14, and a pressure regulator 15. From the pressure regulator 15, fluid communication is provided to a quick coupling connector 17 with a hose 16.

The tank 12 of the portable detachable control fluid supply 11 may be filled with via the fill valve 13 from a main control fluid supply, such as a compressed air system. In order to maximize capacity, the tank 12 may be filled up to a pressure substantially higher than the desired control fluid pressure. The pressure gauge 14 is provided for indicating when the tank 12 needs to be refilled and to prevent overfilling. The pressure regulator 15, in turn, may be set to provide a desired pressure. Hence, when in use, the pressure regulator 15 is set to correspond to the determined desired control fluid pressure. The pressure regulator is connected to the quick coupling connector 17 via the hose 16 for easy coupling with the charging valve of a sparging device.

The invention claimed is:

1. A sparger device for sparging fluid into a slurry tank, said sparger device comprising:

a hollow elongated body having a nozzle opening at a distal end thereof for sparging a sparging fluid flow to a slurry tank from an inside of the hollow elongated body, the inside of the elongated hollow body being configurable for fluid communication with a sparging fluid supply, when in use:

a needle, movably arranged along a longitudinal axis of the sparger device within the hollow elongated body, the needle having a first end for opening and closing the nozzle opening in order to allow, and respectively block fluid flow via the nozzle opening, and a control device coupled with a second end of the needle, the control device being arranged to actuate the needle along the longitudinal axis so as to open or close the nozzle opening, wherein the control device comprises a control chamber partitioned by a piston member into a first portion and second portion, the piston member being coupled with the needle, and configured to be movable within the control chamber along the longitudinal axis in response to a pressure differential between the first portion and the second portion, such that:

a lower fluid pressure in the first portion with respect to that of the second portion will move the needle against the nozzle opening, thereby closing it, and respectively, a higher fluid pressure in the first portion with respect to that of the second portion will move the needle away from the nozzle opening, thereby opening it, wherein the first portion of the control chamber being in fluid communication with the inside of the elongated hollow body, thereby defining the fluid pressure within the first portion to equal with that of the sparging fluid supply, when in use, and the second portion of the control chamber being configurable for being in fluid communication with a control fluid, thereby defining the fluid pressure within the second portion to equal with that of a control fluid, when in use, whereby backflow of slurry from the slurry tank to the sparger device via the nozzle opening may be prevented by providing a control fluid pressure exerting, on the piston member, a force greater than that exerted on the first end of the needle by the fluid pressure of the slurry tank at a level of the sparger device, wherein the control device comprising a pressure sensor for providing information indicative of the fluid pressure within the second portion of the control chamber, and wherein the sparger device comprises a charging valve for charging the second portion of the control chamber with a desired control fluid pressure, said charging valve being provided as a pneumatic or hydraulic quick coupling connector.

2. The sparger device according to claim 1, wherein the pressure sensor is arranged on a continuation of the longitudinal axis of the sparger device.

3. The sparger device according to claim 1, wherein the second portion of the control chamber is configurable for being in fluid communication with a control fluid supply.

4. A flotation apparatus comprising a slurry tank, further comprising at least one sparger device according to claim 1, the at least one sparger device being arranged such that at least the nozzle opening is within the tank.

5. The flotation apparatus according to claim 4 wherein the sparger device being arranged such that the elongated hollow body extends horizontally within the tank.

6. The flotation apparatus according to claim 4, wherein the second portion of the control chamber comprising control fluid arranged at a control fluid pressure exerting, on the piston member, a force greater than that exerted on the first end of the needle by a fluid pressure prevailing in the slurry tank at a level of the sparger device.

7. A flotation system comprising the flotation apparatus according to claim 4, wherein the flotation system further comprises:

a sparging fluid supply arranged to be in fluid communication with the inside of the hollow elongated body of the sparger device for sparging said sparging fluid into the flotation tank;

a control fluid supply arranged to be in fluid communication with the second portion of the control chamber for providing a control fluid pressure within the second portion of the control chamber, wherein the sparging fluid supply and the control fluid supply are associated with respective separate devices.

8. A method of setting a control fluid pressure of a sparger device for sparging fluid into a slurry tank, comprising:

providing a sparger device according to claim 1;

providing a detachable control fluid supply;

determining a desired control pressure, such that said desired control pressure exerts, on the piston member, a force greater than that exerted on the first end of the needle by a fluid pressure prevailing in the slurry tank at a level of the sparger device;

connecting the detachable control fluid supply to the charging valve for establishing fluid communication between the second portion of the control chamber and the detachable control fluid supply, and charging the second portion of the control chamber with a desired control fluid pressure.

* * * * *